US009557137B2

(12) United States Patent
Dzwill

(10) Patent No.: US 9,557,137 B2
(45) Date of Patent: Jan. 31, 2017

(54) ADJUSTABLE FREE-FLOAT FOREND/HANDGUARD MOUNTING ASSEMBLY

(71) Applicant: BERETTA USA CORP., Accokeek, MD (US)

(72) Inventor: Alexander Edward Dzwill, Accokeek, MD (US)

(73) Assignee: BERETTA U. S. A. CORP., Accokeek, MD (US)

( * ) Notice: Subject to any disclaimer, the term of this patent is extended or adjusted under 35 U.S.C. 154(b) by 0 days.

(21) Appl. No.: 14/830,376

(22) Filed: Aug. 19, 2015

(65) Prior Publication Data

US 2016/0054096 A1 Feb. 25, 2016

Related U.S. Application Data

(60) Provisional application No. 62/038,902, filed on Aug. 19, 2014.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41A 21/482; F41A 21/48; F41A 5/18; F41G 11/003
USPC ..... 42/71.01, 75.01–75.02, 75.1
See application file for complete search history.

(56) References Cited

U.S. PATENT DOCUMENTS

| | | | | |
|---|---|---|---|---|
| 2,685,754 | A * | 8/1954 | Crittendon | F41A 3/26 42/16 |
| 5,412,895 | A | 5/1995 | Krieger | |
| 6,499,245 | B1 * | 12/2002 | Swan | F41C 23/00 42/124 |
| 6,671,990 | B1 | 1/2004 | Booth | |
| RE39,465 | E * | 1/2007 | Swan | 42/124 |

(Continued)

OTHER PUBLICATIONS

International Search Report and Written Opinion of the International Searching Authority dated Nov. 4, 2015 for Application No. PCT/US2015/045925.

(Continued)

*Primary Examiner* — Michael David
(74) *Attorney, Agent, or Firm* — Ladas & Parry LLP

(57) ABSTRACT

An adjustable free-float forend/handguard mounting assembly for a small arms weapon, for attaching a forend/handguard to the small arms weapon. The assembly includes a barrel nut having internal female threads at a forward end and internal female threads at an opposite rearward end and having a plurality of radial utility holes. The assembly further includes a jam ring having internal cylindrical surfaces and having a plurality of threaded radial mounting holes, a washer, and a jam bolt having a hollow cylindrical body with a rearwardly extending externally male threaded portion and a forward external collar portion. The jam ring is rotatingly supported on its internal cylindrical surfaces for free rotation about the male threaded portion and the forward external collar portion of the jam bolt. The washer and the jam ring have similar internal diameters and are each similarly mounted on the jam bolt. The rearwardly extending externally male threaded portion of the jam bolt is adapted to engage with the internal female threads at the forward end of the barrel nut.

22 Claims, 4 Drawing Sheets

(56) References Cited

U.S. PATENT DOCUMENTS

| | | | | |
|---|---|---|---|---|
| 7,458,179 | B2 * | 12/2008 | Swan | F41G 11/003 42/105 |
| 7,716,865 | B2 * | 5/2010 | Daniel | F41C 23/16 42/75.01 |
| 7,770,317 | B1 * | 8/2010 | Tankersley | F41C 23/16 42/71.01 |
| 8,069,604 | B2 | 12/2011 | Larue | |
| 8,141,285 | B2 | 3/2012 | Brown | |
| 8,141,289 | B2 * | 3/2012 | Gomez | F41C 23/16 42/90 |
| 8,251,051 | B2 | 8/2012 | Maggiore | |
| 8,276,303 | B2 | 10/2012 | Kapusta et al. | |
| 8,448,367 | B2 | 5/2013 | Samson et al. | |
| 8,453,364 | B2 | 6/2013 | Kucynko | |
| 8,782,943 | B2 * | 7/2014 | Jarboe | F41A 21/485 42/75.02 |
| 9,140,506 | B2 * | 9/2015 | Gomez | F41A 21/487 |
| 9,322,609 | B2 * | 4/2016 | Davies | F41A 3/94 |
| 9,423,194 | B2 * | 8/2016 | Fritz | F41A 5/18 |
| 9,476,672 | B2 * | 10/2016 | Wells | F41C 23/16 |
| 2003/0230022 | A1 * | 12/2003 | Battaglia | F41G 11/003 42/111 |
| 2004/0049964 | A1 | 3/2004 | Vais | |
| 2006/0065112 | A1 * | 3/2006 | Kuczynko | F41A 5/28 89/193 |
| 2007/0017139 | A1 | 1/2007 | Larue | |
| 2010/0095575 | A1 * | 4/2010 | Swan | F41G 11/003 42/72 |
| 2011/0247254 | A1 | 10/2011 | Barnes | |
| 2012/0324775 | A1 | 12/2012 | Troy et al. | |
| 2013/0180151 | A1 | 7/2013 | Moore | |
| 2014/0075817 | A1 | 3/2014 | Gomez | |

OTHER PUBLICATIONS

AR-15 Builder's Resource Manual, Chapter 9—Exploded Diagram, Gunsnet.net, Version 1 (Rev 1), p. 45, Jordan Edgar, Copyright 2006, http://www.gunsnet.net/manuals/Builders_Guide.pdf.

* cited by examiner

ADJUSTABLE FREE-FLOAT FOREND/HANDGUARD MOUNTING ASSEMBLY

RELATED APPLICATION

The present application claims the benefit under 35 U.S.C. 119(e) of U.S. Provisional Appln. No. 62/038,902 filed Aug. 19, 2014, the entire contents of which are incorporated herein by reference.

BACKGROUND OF THE INVENTION

The present invention relates generally to the mounting of a forend/handguard to small arms weapons.

The standard mounting arrangement of the handguard/forend for the M-16 or AR-15 rifles or comparable small arms weapons secures the hanguard/forend to the upper receiver and barrel in a manner in which the gun barrel is concentric with the forend/handguard. This forend standard assembly protects the hands of the shooter and provides mounting sites for accessories.

Typical existing arrangements for affixing a forend/handguard to the upper receiver of an AR-15 or M-16 replace or are integrated with the barrel mounting hardware which is referred to as the barrel nut. The standard installation of both the barrel and the forend/handguard utilize a separate fixture requiring the alignment of the specific mounting mechanism features by over-torqueing the barrel nut, commonly described as "timing" the barrel nut. In certain circumstances, this is less than ideal since over-torqueing is insufficient to properly align the locking elements. It has been proposed to file or to shim the front face of the upper receiver to properly "time" all the mechanical locking elements.

There are alternative forend/handguard mounting systems which do not require "timing" the barrel nut relying instead upon other independent means of attachment. However, the alternatives often are prone to misalignment.

There exists, therefore, a need to provide a novel system that overcomes the above-noted and other drawbacks of the existing systems.

SUMMARY OF THE PRESENT INVENTION

The mounting arrangement of the present invention provides an effective improvement over earlier forend/handguard mounting systems. The new design of the invention provides a barrel nut and forend/handguard attachment mechanism that is infinitely adjustable and requires no "timing" of threaded components. There are four fundamental components in the new arrangement of an embodiment of the present invention, namely: a main nut; a jam ring; a washer; and jam bolt. The main nut is internally female threaded at each of its opposite ends with the rearward end attaching to the mating male threads formed on the upper receiver and the female threaded forward end receiving the male threads on the jam bolt. The jam ring is provided with radial holes which are aligned with corresponding radial holes on the forend/handguard to accommodate the free float mounting of the forend/handguard. The jam ring and the washer both are sized to engage the jam bolt. The jam bolt has a rear male threaded portion to lockingly engage with the forward female threaded portion of the main nut to complete the assembly.

Specifically, the main nut or barrel nut is provided with spanner wrench holes and is threaded on to the mating male threads of the upper receiver utilizing a standard spanner wrench which is readily available in the field for AR-15 and M-16 platform weapons. The main nut requires no "timing" and thus may be quickly and properly installed without extra effort or additional tools. The jam ring is not threaded and is infinitely adjustable through rotation about the jam bolt. Thus, it may be "timed" independently of the main nut. This arrangement allows the achievement of perfect alignment between the upper receiver and the forend/handguard without over-torqueing of the barrel nut. The jam bolt itself may be simply and properly tightened with a standard open end wrench without any "timing." The jam ring design is infinitely adjustable and will allow proper alignment of the forend while maintaining the correct torque specifications for the barrel. This design allows the user to easily install a low profile free-float forend to any Mil-Spec upper receiver without the use of any proprietary tools or fixtures.

The present invention in one aspect provides an adjustable free-float forend/handguard mounting assembly for a small arms weapon, for attaching a forend/handguard to the small arms weapon. The assembly includes a barrel nut having internal female threads at a forward end and internal female threads at an opposite rearward end and having a plurality of radial utility holes. The assembly further includes a jam ring having internal cylindrical surfaces and having a plurality of radial mounting holes, and a jam bolt having a hollow cylindrical body with a rearwardly extending externally male threaded portion and a forward external collar portion. The jam ring is rotatingly supported on its internal cylindrical surfaces for free rotation about the male threaded portion and the forward external collar portion of the jam bolt. The jam ring is mounted on the jam bolt. The rearwardly extending externally male threaded portion of the jam bolt is adapted to engage with the internal female threads at the forward end of the barrel nut.

The invention in another aspect provides an adjustable free-float forend/handguard mounting assembly for a small arms weapon that has an upper receiver supporting a forwardly projecting gun barrel, for attaching a forend/handguard to the upper receiver. The assembly includes a barrel nut having internal female threads at a forward end and internal female threads at an opposite rearward end and having a plurality of radial utility holes, wherein the internal female threads at the rearward end mate with male threads on the upper receiver to thread the barrel nut to the upper receiver. The assembly also includes a jam ring having internal cylindrical surfaces and a jam bolt having a hollow cylindrical body with a rearwardly extending externally male threaded portion and an external collar portion. The jam ring is rotatingly supported on its internal cylindrical surfaces for free rotation about the male threaded portion and the external collar portion of the jam bolt. The jam ring is mounted on the jam bolt. The jam ring has a plurality of radial mounting holes which are adapted to align with the same number of mounting holes formed on bottom and opposite sides of a rearward portion of the forend/handguard. The rear male threaded portion of the jam bolt is adapted to lockingly engage with the internal female threads at the forward end of the barrel nut.

The invention in another aspect provides an adjustable free-float forend/handguard mounting assembly for a small arms weapon that has an upper receiver supporting a forwardly projecting gun barrel, for attaching a forend/handguard to the upper receiver. The assembly includes a barrel nut having a plurality of radial utility holes and having internal female threads at forward and rearward ends of the barrel nut, wherein the barrel nut is adapted to be threaded to the upper receiver through the internal female threads at the rearward end. The assembly further includes a jam ring having internal cylindrical surfaces, a washer, and a jam bolt having a hollow cylindrical body with a rearward male threaded portion and a forward collar. The jam ring is rotatingly supported on its internal cylindrical surfaces for free rotation about the rearward male threaded portion and the collar of the jam bolt such that the jam ring is infinitely adjustable through rotation about the jam bolt. The washer and the jam ring have similar internal diameters and are each similarly mounted on the jam bolt. The jam ring has a plurality of radial mounting holes which are adapted to align with corresponding mounting holes formed on the forend/handguard. The rearward male threaded portion of the jam bolt is adapted to be threaded to the internal female threads at the forward end of the barrel nut.

For a more complete understanding of the mounting system of the present invention and a better appreciation of its attendant advantages, reference should be made to the following detailed description of the invention taken in conjunction with the accompanying drawings.

DETAILED DESCRIPTION OF THE INVENTION

Figure 1:
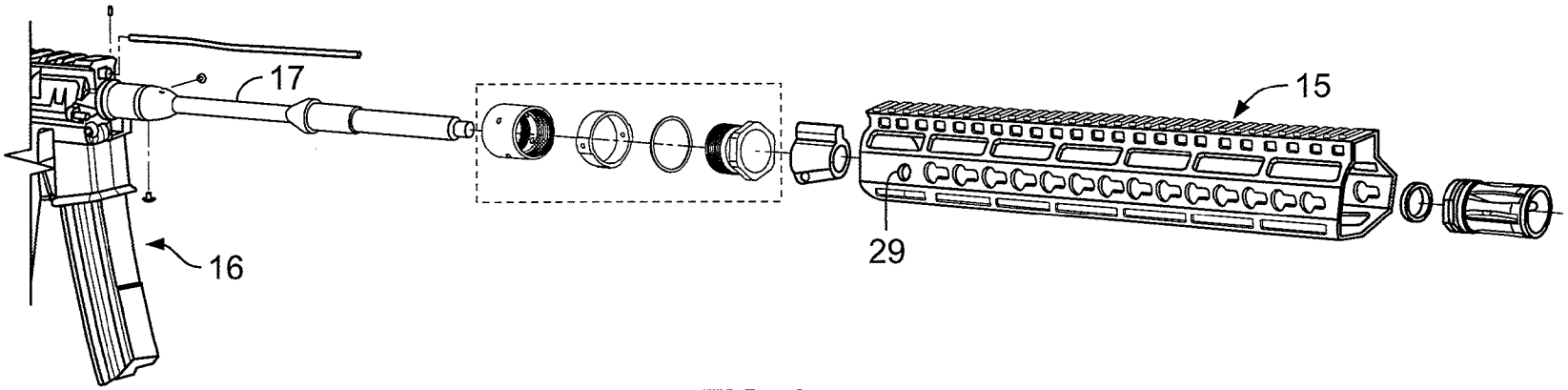
FIG. 1 is an exploded perspective view of the mounting assembly according to an embodiment of the present invention including the upper receiver of an AR-15/M-16 type rifle, gun barrel, a forend/handguard; the main nut (barrel nut), jam ring, washer, and jam bolt employed to attach the forend/handguard to the receiver.
Figure 2:
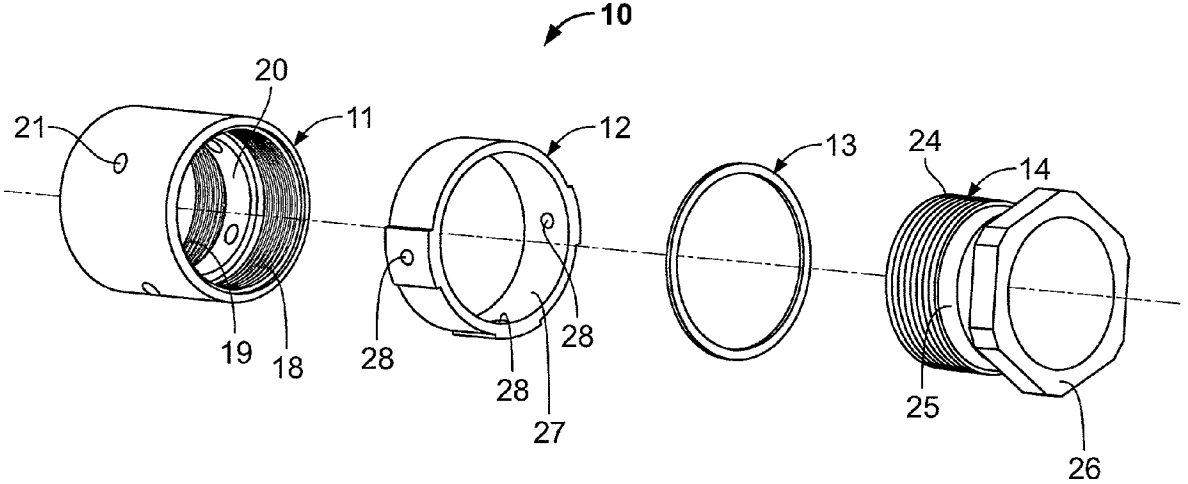
FIG. 2 is an exploded, enlarged perspective view of the main nut (barrel nut), jam ring, washer, and jam bolt employed to attach the forend/handguard to the receiver.
Figure 3:
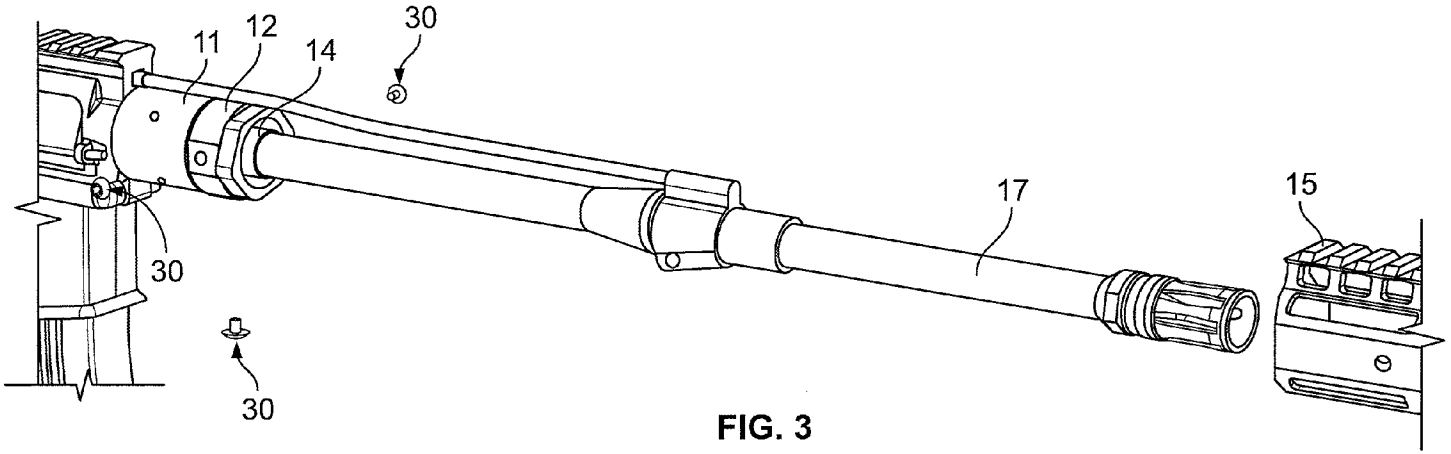
FIG. 3 is a perspective view of the nut assembly of the invention securing the barrel to the upper receiver preparatory to mounting the forend/handguard through the jam ring.
Figure 4:
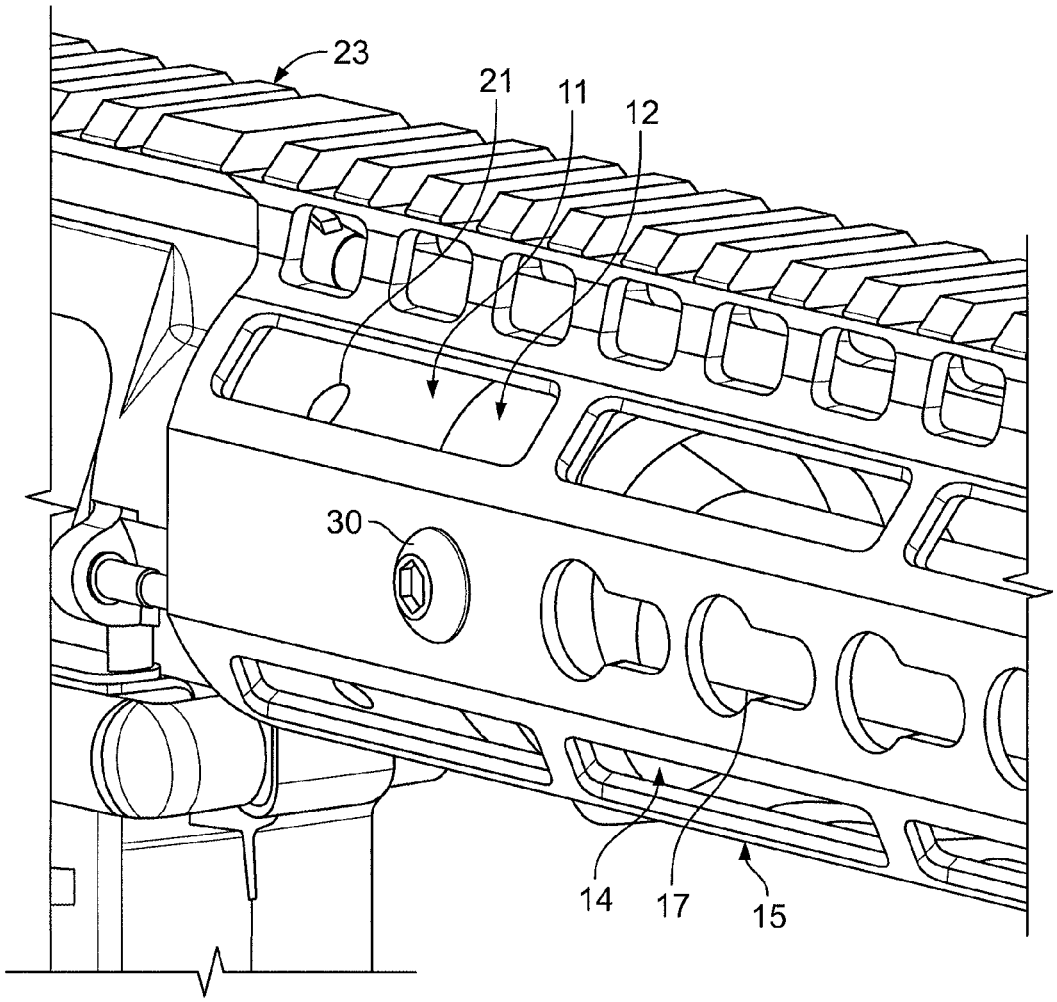
FIG. 4 is an enlarged exterior perspective view showing the forend/handguard attached to the nut assembly.

Referring to FIGS. 1-5, in accordance with the principles of the present invention, a very simple barrel nut assembly 10, comprising a main nut/barrel nut 11; a jam ring 12; a washer 13; and jam bolt 14, is utilized to attach a forend/handguard 15 to the upper receiver 16 of an AR-15/M-16 type rifle 16 supporting a forwardly projecting gun barrel 17.

Figure 5:
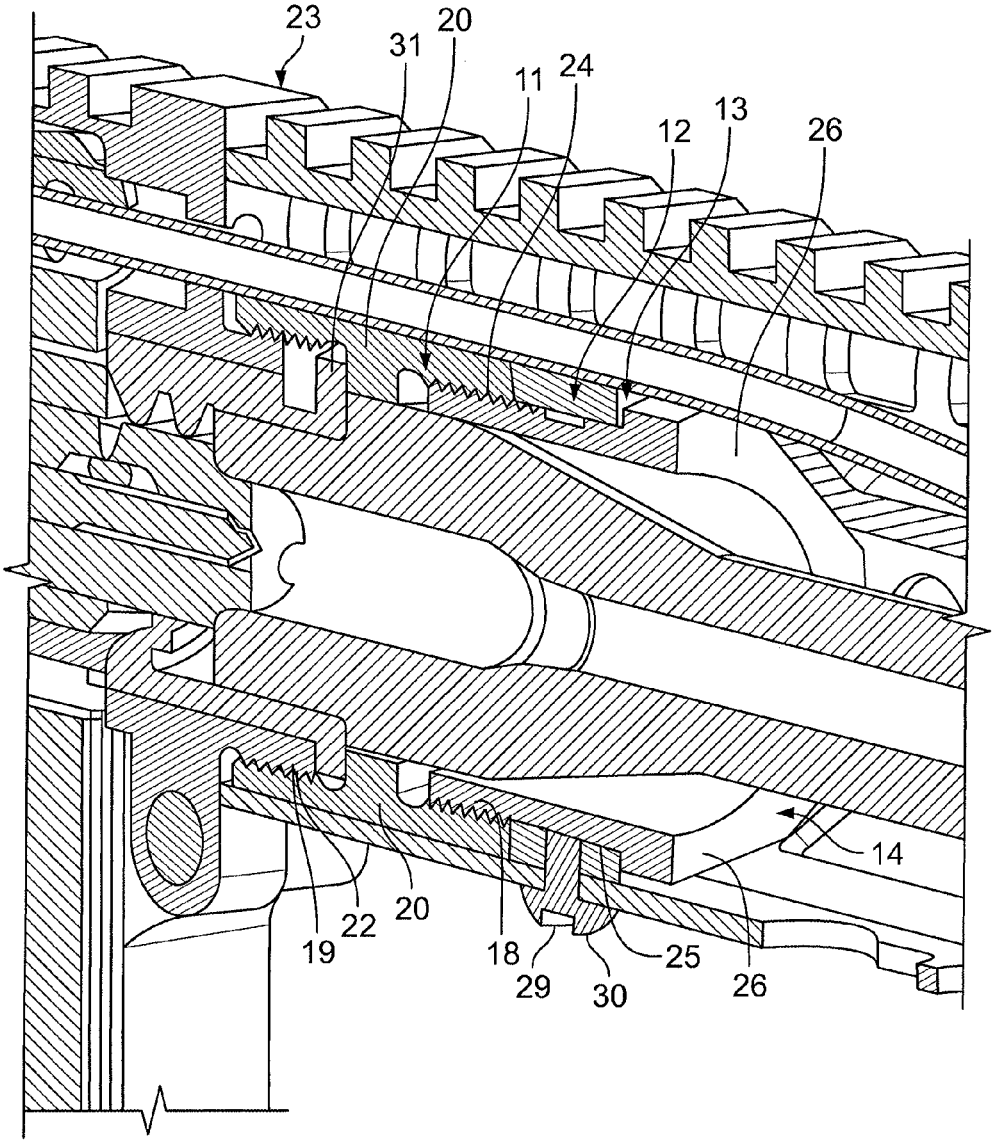
FIG. 5 is a vertical cross-sectional interior perspective view through the external perspective view of FIG. 4.

The barrel nut 11 has internal female threads 18 at its forward end and internal female threads 19 at its rearward end. The opposite threaded ends 18, 19 are separated by an internal annular locking shoulder 20. Any suitable number of radial utility holes 21 from one to several (i.e., not limited to the number shown in the drawings) are formed in central portions of the barrel nut body to give purchase to a spanner wrench (not shown) for threading the barrel nut 11 to the upper receiver 16 through mating male threads 22 formed on the upper receiver 23 (FIG. 5) which mate with the internal female threads 19 at the rearward end. The barrel nut 11 secures the barrel to the upper receiver 16 by clamping as shown in FIG. 5. The female-threaded forward end 18 of the barrel nut 11 receives male threads on the jam bolt 14.

The jam bolt 14 has a hollow cylindrical body with a rearwardly extending externally threaded male portion 24, an external collar portion 25, and a hexagonal head portion 26.

The jam ring 12 is rotatingly supported on its internal cylindrical surfaces 27 for free rotation about the threaded portion 24 and collar 25 of the jam bolt 14, the inner diameter of the jam ring 12 being just slightly greater than the outer diameter of the jam bolt 14. The washer 13 has an inner diameter similar to that of the jam ring 12 and is similarly mounted on the jam bolt 14. The washer 13 can make for optimal fastening between the jam ring 12 and the jam bolt 14 and therefore is for use in a preferred embodiment, but other embodiments need not incorporate the washer 13. The jam ring 12 in this embodiment has three threaded radial mounting holes 28 (although the present invention is not limited to this number of radial mounting holes 28 and any suitable number from one to several may be used, and further the holes 28 need not be threaded in other embodiments) which are designed to align with three or a corresponding number of mounting holes or clearance holes 29 formed on the bottom and opposite sides of the rearward portion of the forend/handguard 15, to accommodate free-float mounting of the forend/handguard 15. Screws 30 can go through each threaded radial mounting hole 28 and each corresponding mounting hole 29 to attach the handguard 15 to the jam ring 12 with the ring free floatingly supported so that the holes 28 line up with the holes 29. The screws 30 may be, e.g., cap screws with a custom or specific head design. Alternate methods of attaching the forend/handguard 15 may include the use of captured fasteners or pins mounted in the forend/handguard 15 engaged in slots or holes 28 (threaded or otherwise) in the jam ring 12, quarter-turn style cam-lock fasteners for rapid installation/removal, slot and pin engagement arrangements, clamping devices with appropriate locating features, quick release ball-lock style pins, and other similar or suitable fastening methods. The presence of threaded holes 28 in the jam ring 12 is a preferred embodiment, and not a required feature of the system. It is further noted that the jam ring 12 as shown in the drawings has flat sides surrounding holes 28 but the jam ring need not have such flat sides in other embodiments.

Importantly, the assembly of the handguard 15 to the upper receiver 16 is effected without any "timing" issues. The barrel nut 11 is threaded onto the mating threaded portion of the upper receiver 23 utilizing an ordinary spanner wrench engaging the utility holes 21. Tightening the barrel nut 11 will secure the gun barrel 17 to the receiver 23 by clamping radial barrel portion 31 between the receiver 23 and the barrel nut 11 as shown in FIG. 5.

The jam bolt 26 may be threaded into the forward opening of the barrel nut 11 using an open end wrench until it is tightly secured without concern for "timing" or over-torqueing; that is, the rear male threaded portion 24 of the jam bolt 14 lockingly engages with the forward female threaded portion 18 of the barrel nut 11. The holes 28 in the jam ring 12 may be readily aligned with the holes 29 in the forend 15 for subsequent secure fastening by the screws 30.

Importantly and as a special feature, the jam ring design is infinitely adjustable and will accommodate proper alignment of the forend/handguard while maintaining the correct torque specs for the barrel. This design allows the user to easily install a low profile free-float forend/handguard to any Mil-Spec upper receiver without the use of any proprietary tools or fixtures.

It should be understood, of course, that the specific form of the invention herein illustrated and described is intended to be representative only, as certain changes may be made therein without departing from the clear teachings of the disclosure.

In addition, it should be understood that the figures illustrated in the attachments, which highlight the functionality and advantages of the present invention, are presented for example purposes only. The architecture of the present invention is sufficiently flexible and configurable, such that it may be utilized (and navigated) in ways other than that shown in the accompanying figures.

The invention claimed is:

1. An adjustable free-float forend/handguard mounting assembly for a small arms weapon, for attaching a forend/handguard to the small arms weapon, comprising:

a barrel nut having internal female threads at a forward end and internal female threads at an opposite rearward end and having a plurality of radial utility holes;

a jam ring having an internal cylindrical surface and having a plurality of radial mounting holes; and a jam bolt having a hollow cylindrical body with a rearwardly extending externally male threaded portion and a forward external collar portion, wherein the jam ring is rotatingly supported on its internal cylindrical surface for free rotation about the male threaded portion and the forward external collar portion of the jam bolt, wherein the jam ring is mounted on the jam bolt, and wherein the rearwardly extending externally male threaded portion of the jam bolt is adapted to engage with the internal female threads at the forward end of the barrel nut.

2. The adjustable free-float forend/handguard mounting assembly as set forth in claim 1, wherein the internal female threads at the rearward end of the barrel nut mate with male threads on an upper receiver of the small arms weapon to thread the barrel nut to the upper receiver.

3. The adjustable free-float forend/handguard mounting assembly as set forth in claim 1, wherein the plurality of radial mounting holes on the jam ring are adapted to align with corresponding mounting holes formed on bottom and opposite sides of a rearward portion of the forend/handguard.

4. The adjustable free-float forend/handguard mounting assembly of claim 3, wherein the radial mounting holes formed on the jam ring are threaded.

5. The adjustable free-float forend/handguard mounting assembly of claim 4, further comprising a plurality of screws for sliding into the threaded radial mounting holes on the jam ring and the mounting holes formed on the forend/handguard to attach the forend/handguard to the jam ring, with the jam ring free floatingly supported so that the threaded radial mounting holes on the jam ring line up with the mounting holes formed on the forend/handguard for secure fastening.

6. The adjustable free-float forend/handguard mounting assembly of claim 2, wherein the barrel nut is adapted to be threaded onto the upper receiver utilizing a spanner wrench engaging the radial utility holes of the barrel nut to clamp a radial barrel portion between the receiver and the barrel nut.

7. The adjustable free-float forend/handguard mounting assembly of claim 1, wherein the jam bolt further comprises a hexagonal head portion.

8. The adjustable free-float forend/handguard mounting assembly of claim 7, wherein the jam bolt is adapted to be threaded to the internal female threads at the forward end of the barrel nut utilizing an open end wrench engaging the hexagonal head portion.

9. The adjustable free-float forend/handguard mounting assembly of claim 1, wherein the forward and rearward ends of the barrel nut are separated by an internal annular locking shoulder.

10. The adjustable free-float forend/handguard mounting assembly of claim 1, wherein the plurality of radial utility holes on the barrel nut are formed in central portions of the barrel nut.

11. An adjustable free-float forend/handguard mounting assembly for a small arms weapon that has an upper receiver supporting a forwardly projecting gun barrel, for attaching a forend/handguard to the upper receiver, comprising:

a barrel nut having internal female threads at a forward end and internal female threads at an opposite rearward end and having a plurality of radial utility holes, wherein the internal female threads at the rearward end mate with male threads on the upper receiver to thread the barrel nut to the upper receiver;

a jam ring having an internal cylindrical surface; and a jam bolt having a hollow cylindrical body with a rearwardly extending externally male threaded portion and an external collar portion, wherein the jam ring is rotatingly supported on its internal cylindrical surface for free rotation about the male threaded portion and the external collar portion of the jam bolt, wherein the jam ring is mounted on the jam bolt, wherein the jam ring has a plurality of radial mounting holes which are adapted to align with the same number of mounting holes formed on bottom and opposite sides of a rearward portion of the forend/handguard, and wherein the rear male threaded portion of the jam bolt is adapted to lockingly engage with the internal female threads at the forward end of the barrel nut.

12. The adjustable free-float forend/handguard mounting assembly of claim 11, wherein the barrel nut is adapted to be threaded onto the upper receiver utilizing a spanner wrench engaging the radial utility holes of the barrel nut to clamp a radial barrel portion between the receiver and the barrel nut.

13. The adjustable free-float forend/handguard mounting assembly of claim 11, wherein the jam bolt further comprises a hexagonal head portion.

14. The adjustable free-float forend/handguard mounting assembly of claim 13, wherein the jam bolt is adapted to be threaded to the internal female threads at the forward end of the barrel nut utilizing an open end wrench engaging the hexagonal head portion.

15. The adjustable free-float forend/handguard mounting assembly of claim 11, wherein the radial mounting holes on the jam ring are threaded, the assembly further comprising a plurality of screws for sliding into the threaded radial mounting holes on the jam ring and the mounting holes formed on the forend/handguard to attach the forend/handguard to the jam ring, with the jam ring free floatingly supported so that the threaded radial mounting holes on the jam ring line up with the mounting holes formed on the forend/handguard for secure fastening.

16. An adjustable free-float forend/handguard mounting assembly for a small arms weapon that has an upper receiver supporting a forwardly projecting gun barrel, for attaching a forend/handguard to the upper receiver, comprising:

a barrel nut having a plurality of radial utility holes and having internal female threads at forward and rearward ends of the barrel nut, wherein the barrel nut is adapted to be threaded to the upper receiver through the internal female threads at the rearward end;

a jam ring having an internal cylindrical surface;

means for mounting the jam ring to the forend/handguard; and a jam bolt having a hollow cylindrical body with a rearward male threaded portion and a forward collar, wherein the jam ring is rotatingly supported on its internal cylindrical surface for free rotation about the rearward male threaded portion and the collar of the jam bolt such that the jam ring is infinitely adjustable through rotation about the jam bolt, wherein the jam ring is mounted on the jam bolt, and wherein the rearward male threaded portion of the jam bolt is adapted to be threaded to the internal female threads at the forward end of the barrel nut.

17. A small arms weapon comprising an upper receiver supporting a forwardly projecting gun barrel, a forend/handguard attached to the upper receiver, and an adjustable free-float forend/handguard mounting assembly as set forth in claim 1 for attaching the forend/handguard to the upper receiver.

18. A forend/handguard for attaching to an upper receiver of a small arms weapon, comprising an adjustable free-float forend/handguard mounting assembly as set forth in claim 1.

19. The adjustable free-float forend/handguard mounting assembly as set forth in claim 1, further comprising a washer, wherein the washer and the jam ring have similar internal diameters and are each similarly mounted on the jam bolt.

20. The adjustable free-float forend/handguard mounting assembly as set forth in claim 11, further comprising a washer, wherein the washer and the jam ring have similar internal diameters and are each similarly mounted on the jam bolt.

21. An adjustable free-float forend/handguard mounting assembly for a small arms weapon, for attaching a forend/handguard to the small arms weapon, comprising:

a barrel nut having internal female threads at a forward end and internal female threads at an opposite rearward end and having a plurality of radial utility holes;

a jam ring having an internal cylindrical surface;

means for mounting the jam ring to the forend/handguard; and a jam bolt having a hollow cylindrical body with a rearwardly extending externally male threaded portion and a forward external collar portion, wherein the jam ring is rotatingly supported on its internal cylindrical surface for free rotation about the male threaded portion and the forward external collar portion of the jam bolt, wherein the jam ring is mounted on the jam bolt, and wherein the rearwardly extending externally male threaded portion of the jam bolt is adapted to engage with the internal female threads at the forward end of the barrel nut.

22. The adjustable free-float forend handguard mounting assembly as set forth in claim 1, wherein the means for mounting the jam ring to the forend/handguard comprise one of:

a clamping device;

a plurality of slots or orifices on the jam ring which are adapted to align with corresponding mounting slots or orifices on the forend/handguard to be engaged by fasteners or pins; and a plurality of radial mounting holes on the jam ring which are adapted to align with corresponding mounting holes on the forend/handguard to be engaged by screws.

* * * * *